US005352543A

United States Patent [19]

Ryu

[11] Patent Number: 5,352,543

[45] Date of Patent: Oct. 4, 1994

[54] STRUCTURE OF THIN FILM ELECTROLUMINESCENT DEVICE

[75] Inventor: Jae H. Ryu, Seoul, Rep. of Korea

[73] Assignee: Goldstar Co., Ltd., Seoul, Rep. of Korea

[21] Appl. No.: 785,371

[22] Filed: Oct. 30, 1991

[30] Foreign Application Priority Data

Oct. 31, 1990 [KR] Rep. of Korea ..... 90-17600

[51] Int. Cl.[5] ..... H05B 33/14

[52] U.S. Cl. ..... 428/690; 428/917; 313/506; 313/507; 313/508; 313/509

[58] Field of Search ..... 428/690, 917, 141, 408, 428/213; 313/506-509

[56] References Cited

U.S. PATENT DOCUMENTS 5,156,924 10/1992 Taniguchi et al. ..... 428/690

*Primary Examiner*—Charles R. Nold

*Attorney, Agent, or Firm*—Morgan & Finnegan

[57] ABSTRACT

Disclosed is a thin film electroluminescent device of this invention comprising a transparent substrate, a transparent electrode, a fluorescent layer emitting a light when being charged with a certain voltage, a first and second insulating layer being laminated on the top and the bottom of the fluorescent layer to make a dopant be excited and emit a light efficiently, a first light absorbing layer being laminated on the second insulating layer to improve the function of contrast of the device of electroluminescence, a rear electrode formed on the first light absorbing layer at regular intervals, a rear insulating layer being laminated on the rear electrode to prevent the current from leaking from the rear electrode, and a second light absorbing layer being laminated on the rear insulating layer to blacken the etched portion of the first light absorbing layer. A method of fabrication is also disclosed.

7 Claims, 2 Drawing Sheets

STRUCTURE OF THIN FILM ELECTROLUMINESCENT DEVICE

FIELD OF THE INVENTION

This invention relates to a thin film electroluminescent display device and a method for fabricating it,

TECHNICAL BACKGROUND OF THE INVENTION

Generally an thin film electroluminescent display device has a structure wherein a insulating layer is formed on both sides of a fluorescent layer so as to induce a high electrical field around the fluorescent layer when a certain voltage is loaded on both sides of the fluorescent layer. In a conventional structure of a displaying device of thin film electroluminescence as shown in FIG. 1, a transparent substrate 1 laminates a transparent electrode 2, a first insulating layer 3, a fluorescent layer 4, and a second insulating layer 5 sequentially on itself, and a rear electrode 6 is formed on the second insulating layer 5 at regular intervals.

The transparent electrode 2 and the rear electrode 6 are arrayed in a form of a matrix by line etching at regular intervals and the displaying device of the thin film electroluminescence works by an On/Off switch at cross points of the matrix selectively. A strong electrical field is induced by loading an alternative voltage between the transparent electrode 2 and the rear electrode 6, which makes the electrons of shallow level or deep level of an interfaced surface between the insulating layer 3 or 5 and the fluorescent layer 4 to be accelerated toward an opposite polarity, wherein the accelerated electrons strike $Mn^{2+}$ of the fluorescent layer 4 composed of zinc sulfide ZnS and Manganese Mn. After being struck, an electron in valence band of the $Mn^{2+}$ excited to the conduction state, is returned to the valence band, and then a light with a specific wavelength of 585 nm is radiated from the fluorescent layer.

By selectively applying a voltage on the transparent electrode 2 and the rear electrode 6, the light radiates to the transparent substrate 1 and the rear electrode 6, and the light directed to the rear electrode 6 is reflected and sent to the transparent substrate 1.

Accordingly an image is formed on the displaying device of the thin film electroluminescence by the principle described above.

However, in a conventional device of electroluminescence shown in FIG. 1, it is unable to prevent a light reflected on the rear electrode of which light received from the displaying device and the fluorescent layer because the fluorescent layer 4 has not a light absorbing layer on its rear side. Therefore the performance of the displaying device is deteriorated because a contrast among pixels being on and off becomes poor.

In another conventional device of electroluminescence shown in FIG. 2, a light absorbing layer 7 made of SiNx is introduced to eliminate the above mentioned problem. And the dielectric condition of the light absorbing layer 7 is to have a specific resistance of more than $10^6\Omega$cm. However it is unable to manufacture the layer 7 of SiNx having light absorbing capacity of more than 80% and specific resistance of more than $10^5\Omega$cm by changing the value of 'x' of SiNx. Accordingly the specific resistance being less than $10^5\Omega$cm, the adjacent pixels interfere with one another by leaking electrical current. And the layer of SiNx which is not close fitting reduces the life of the device of thin film electroluminescence.

SUMMARY OF THE INVENTION

The object of this invention is to provide a displaying device of electroluminescence of which life is extended by preventing the adjacent pixels from interfering with one another owing to leaking current and of which function is improved by preventing a light from being reflected on a rear electrode by depositing a light absorbing layer.

According to the present invention, there is provided a thin film electroluminescent device wherein a first light absorbing layer of SiNx being deposited on a second insulating layer and a rear electrode layer being deposited on the first light absorbing layer. The rear electrode layer is etched by a wet process at regular intervals whereby a portion of the first light absorbing layer is exposed and the exposed portion being etched by a ionic reaction process. Thereafter a rear insulating layer is deposited on the etched surface and the rear electrode, and a second light absorbing layer of carbon is deposited on the rear insulating layer.

The thin film electroluminescent device of this invention comprises a transparent substrate, a transparent electrode, a fluorescent layer for emitting a light when being charged with a certain voltage, a first and second insulating layer deposited on the top and the bottom of the fluorescent layer to make a dopant be excited and emit a light efficiently, a first light absorbing layer deposited on the second insulating layer to improve the function of contrast of a displaying element of electroluminescence, a rear electrode formed on the first light absorbing layer at regular intervals, a rear insulating layer deposited on the rear electrode to prevent the rear electrode from leaking current, and a second light absorbing layer deposited on the rear insulating layer for preventing blackening of the etched portion of the first light absorbing layer.

The present invention will now be described more specifically with reference to the drawings attached only by way of example.

DETAILED DESCRIPTION OF A CERTAIN PREFERRED EMBODIMENT

Figure 3:
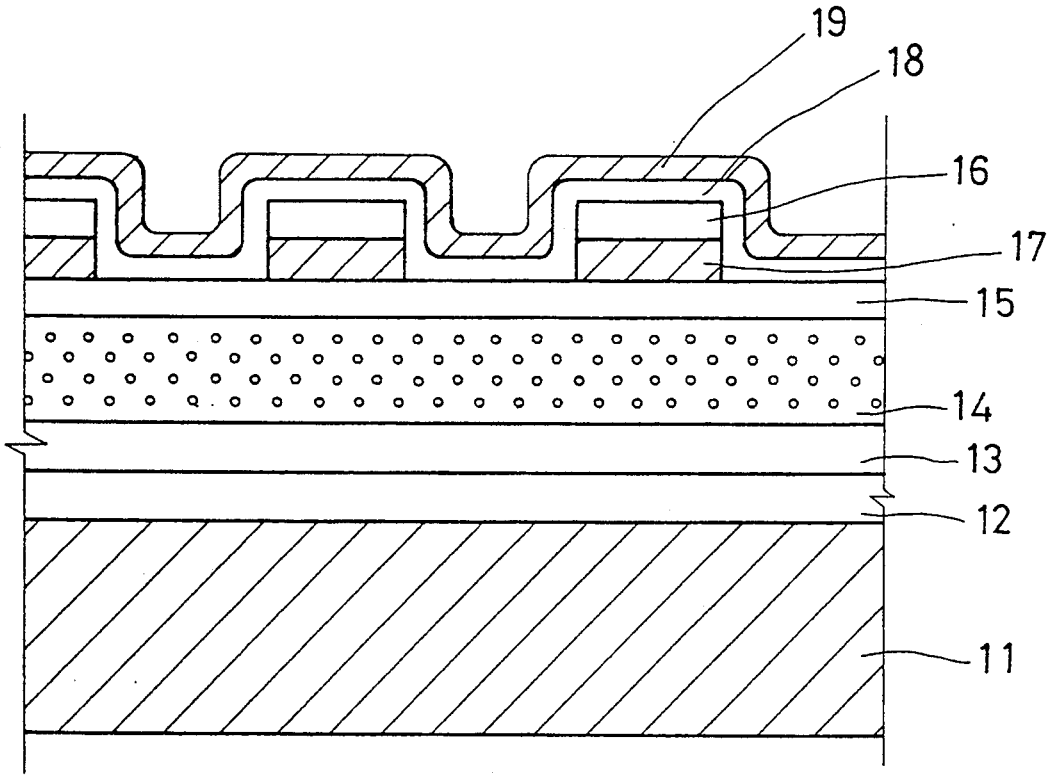
FIG. 3 shows a sectional view of an inventive thin film electroluminescence device.

Referring to FIG. 3, a transparent electrode 12 is laminating on a transparent substrate 11, and a first insulating layer 13 of 200 nm thickness of Si3N4 made from Silicon target and N2 gas by radio frequency Magnetton Sputtering process in a gas reactive furnace is laminating on the transparent electrode 12.

A fluorescent layer 14 formed on the first insulating layer 13 is made from a ZnS pellet doped with 1 mol % of Manganese (Mn) by EB process and treated heat treatment in a vacuum space of 450 C. for 1 hour so as to secure a fine crystallization, a uniform distribution of doping and a quality adhesiveness to the first insulating layer 13.

A second insulating layer of SiON 15 is made from Silicon target and O2+N2 gas by radio frequency (RF) Magnetron Sputtering process in a reactive gas furnace.

A first light absorbing layer of 100–200 nm thickness 17 is made from SiNx short of Nitrogen, of which 'x' value is preferably 0.1–0.5 and less than 1.33, and deposited on the second insulating layer 15.

A rear electrode layer 16 is deposited on the first light absorbing layer 17. Thereafter the rear electrode 16 and the first light absorbing layer 17 are etched by wet method and a reactive ion method with photo resist successively. The reactive ion etching is performed in the mixture of OF4 and 02 gases having the ratio of four to one with 100 watt high frequency power at the pressure of 50 mm Tort for about two and half minutes.

And a rear insulating layer 18 is deposited, after eliminating the photoresist, on the rear electrode 16 under the same conditions as those in depositing the second insulating layer 15.

Finally a carbon layer of 0.1–1 μm thickness is coated on the rear insulating layer 18 by an arc discharge, being a second light absorbing layer 19.

In the inventive thin film electroluminescent device, a high electrical field of MV/cm is induced to the fluorescent layer 14 by charging a voltage of 200 Volts between the transparent electrode 12 and the rear electrode 15. The induced electrical field makes an electron strike Mn with one another internally and the Mn exited by being struck emits a yellow light. The light radiated backwards is absorbed by the first and second light absorbing layer 17 and 19, and the light being radiated forward is displayed through the substrate 11.

Figure 1:
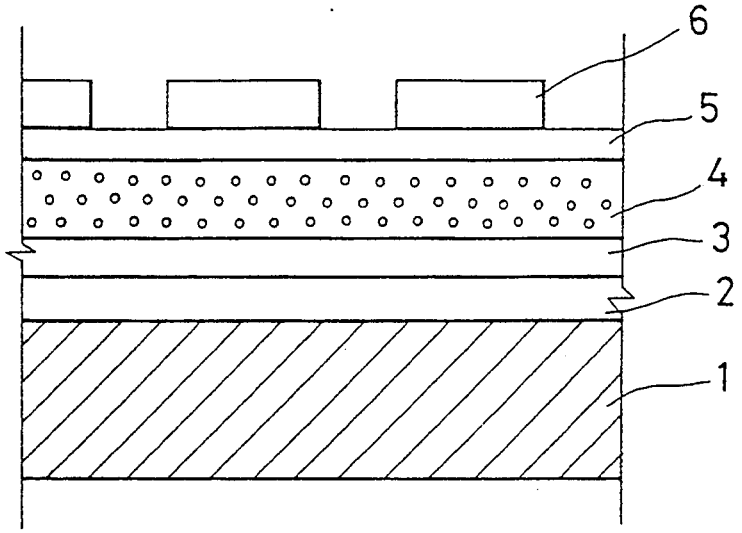
FIG. 1 and FIG. 2 show sectional views of a conventional thin film electroluminescence device.
Figure 2:
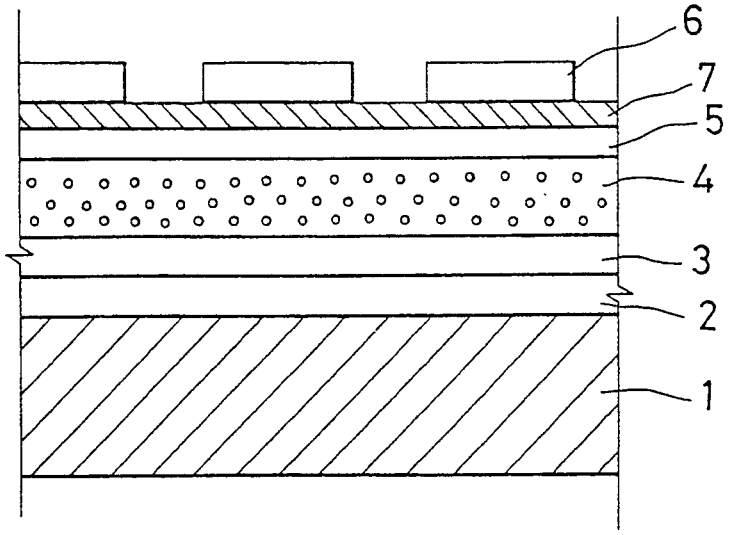

For preventing the current leaking among adjacent rear electrodes through the light absorbing layer 7 as shown in FIG. 2, the first light absorbing layer 17 is etched at the same size of the rear electrode 16 and the rear insulating layer 18 of the same material of the second insulating layer 15 is deposited on the rear electrode 16 as shown in FIG. 3. Further the second light absorbing layer 19 is deposited on the rear insulating layer 18 to prevent blackening of the etched portion of the first light absorbing layer.

In conclusion, the present invention features that the weak adhesiveness owing to different materials is prevented because the material SiNx of the first light absorbing layer 17 is the same kind of material SiON of the second light absorbing layer 19. That is, both SiNx and SiON include the basic insulator element Si, and therefore, are easily attachable to each other. In addition, the current leaking through the first light absorbing layer 17 is prevented by etching the layer to the same size as the rear electrode, and the contrast is improved by depositing the rear insulating layer 18 and the second light absorbing layer 19 to blacken the rear side when the thin film electroluminescent device is operated. Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A thin film electroluminescent device, comprising:

a) a substrate;

b) a transparent electrode formed on said substrate;

c) a first insulating layer formed on said transparent electrode;

d) a fluorescent layer formed on said first insulating layer and including dopants for emitting light when being charged;

e) a second insulating layer formed on said fluorescent layer wherein said first and second insulating layers effectively excite the dopants in said fluorescent layer and make said dopants emit light;

f) a first light absorbing layer formed on said second insulating layer and including an etched portion to improve the effect of contrast by preventing light from being reflected;

g) a rear electrode formed on said first light absorbing layer;

h) a rear insulating layer formed on said rear electrode to prevent current leakage; and i) a second light absorbing layer formed on said rear insulating layer for preventing blackening of the etched portion of said first light absorbing layer.

2. A thin film electroluminescent device as claimed in claim 1, wherein said first light absorbing layer consists of SiNx and the value of 'x' is within 0.1 to 0.5.

3. A thin film electroluminescent device as claimed in claim 1, wherein said rear insulating layer and said second insulating layer comprise identical material.

4. A thin film electroluminescent device as claimed in claim 1, wherein said second light absorbing layer consists of carbon.

5. A thin film electroluminescent device as claimed in claim 1, wherein said first light absorbing layer has a thickness of 100 to 200 nm.

6. A thin film electroluminescent device as claimed in claim 1, wherein the etched portion of said first light absorbing layer is the same size as said rear electrode.

7. A thin film electroluminescent device, comprising:

a) a substrate;

b) a transparent electrode formed on said substrate;

c) a first insulating layer formed on said transparent electrode;

d) a fluorescent layer formed on said first insulating layer and including dopants for emitting light when being charged;

e) a second insulating layer formed on said fluorescent layer wherein said first and second insulating layers effectively excite the dopants in said fluorescent layer and make said dopants emit light;

f) a first light absorbing layer formed on said second insulating layer and including an etched portion to improve the effect of contrast by preventing light from being reflected, wherein said first light absorbing layer is produced from SiNx and the value of 'x' is less than 1.33;

g) a rear electrode formed on said first light absorbing layer;

h) a rear insulating layer formed on said rear electrode to prevent current leakage; and i) a second light absorbing layer formed on said rear insulating layer for preventing blackening of the etched portion of said first light absorbing layer.

* * * * *